US008160285B2

(12) United States Patent
Kragelund

(10) Patent No.: US 8,160,285 B2
(45) Date of Patent: Apr. 17, 2012

(54) WAVEGUIDE UNIT

(75) Inventor: Michael Gjedbo Kragelund, Holstebro (DK)

(73) Assignee: Mike Thomas ApS, Holstebro (DK)

( * ) Notice: Subject to any disclaimer, the term of this patent is extended or adjusted under 35 U.S.C. 154(b) by 1009 days.

(21) Appl. No.: 11/991,972

(22) PCT Filed: Sep. 11, 2006

(86) PCT No.: PCT/DK2006/000500

§ 371 (c)(1),
(2), (4) Date: Mar. 13, 2008

(87) PCT Pub. No.: WO2007/031083

PCT Pub. Date: Mar. 22, 2007

(65) Prior Publication Data

US 2009/0154750 A1 Jun. 18, 2009

(30) Foreign Application Priority Data

Sep. 13, 2005 (DK) ..... 2005 01276

(51) Int. Cl.
*H04R 1/02* (2006.01)
*H04R 1/20* (2006.01)

(52) U.S. Cl. ..... 381/338; 381/337; 381/150

(58) Field of Classification Search ..... 381/150, 381/337–338

See application file for complete search history.

(56) References Cited

U.S. PATENT DOCUMENTS

| | | | | |
|---|---|---|---|---|
| 4,469,921 | A | 9/1984 | Kinoshita | |
| 5,526,456 | A | 6/1996 | Heinz | |
| 6,059,069 | A * | 5/2000 | Hughes, II | 181/152 |
| 2004/0047478 | A1 | 3/2004 | Conbest | |
| 2005/0094836 | A1 * | 5/2005 | Manrique | 381/342 |
| 2005/0175207 | A1 * | 8/2005 | Alexander et al. | 381/340 |

FOREIGN PATENT DOCUMENTS

| | | |
|---|---|---|
| EP | 0915636 | 5/1999 |
| EP | 1333698 | 8/2003 |
| GB | 2248996 | 4/1992 |
| SU | 1317470 | 6/1987 |
| WO | WO 98/09273 | 3/1998 |

* cited by examiner

*Primary Examiner* — Anh Mai
(74) *Attorney, Agent, or Firm* — James Creighton Wray

(57) ABSTRACT

The present invention concerns a waveguide unit, for use with a transducer unit, and in particular transducer of the dome type, where the wave guide unit is substantially circular, and suitable to be arranged around the transducer, where the wave guide unit has a front side on which front side means are provided for reflecting the sound waves from the transducer, and a substantially flat backside, and where substantially centrally in the unit an aperture is provided which aperture is suitable for accommodating a transducer unit, and the side of said aperture connects the front and back sides, where said waveguide comprises one or more diffraction edges arranged concentric with the circular shape of the unit on said front side of the unit, and where adjacent on both sides of said one or more diffraction edges, substantially flat conical surfaces are provided.

9 Claims, 2 Drawing Sheets

WAVEGUIDE UNIT

Figure 1:
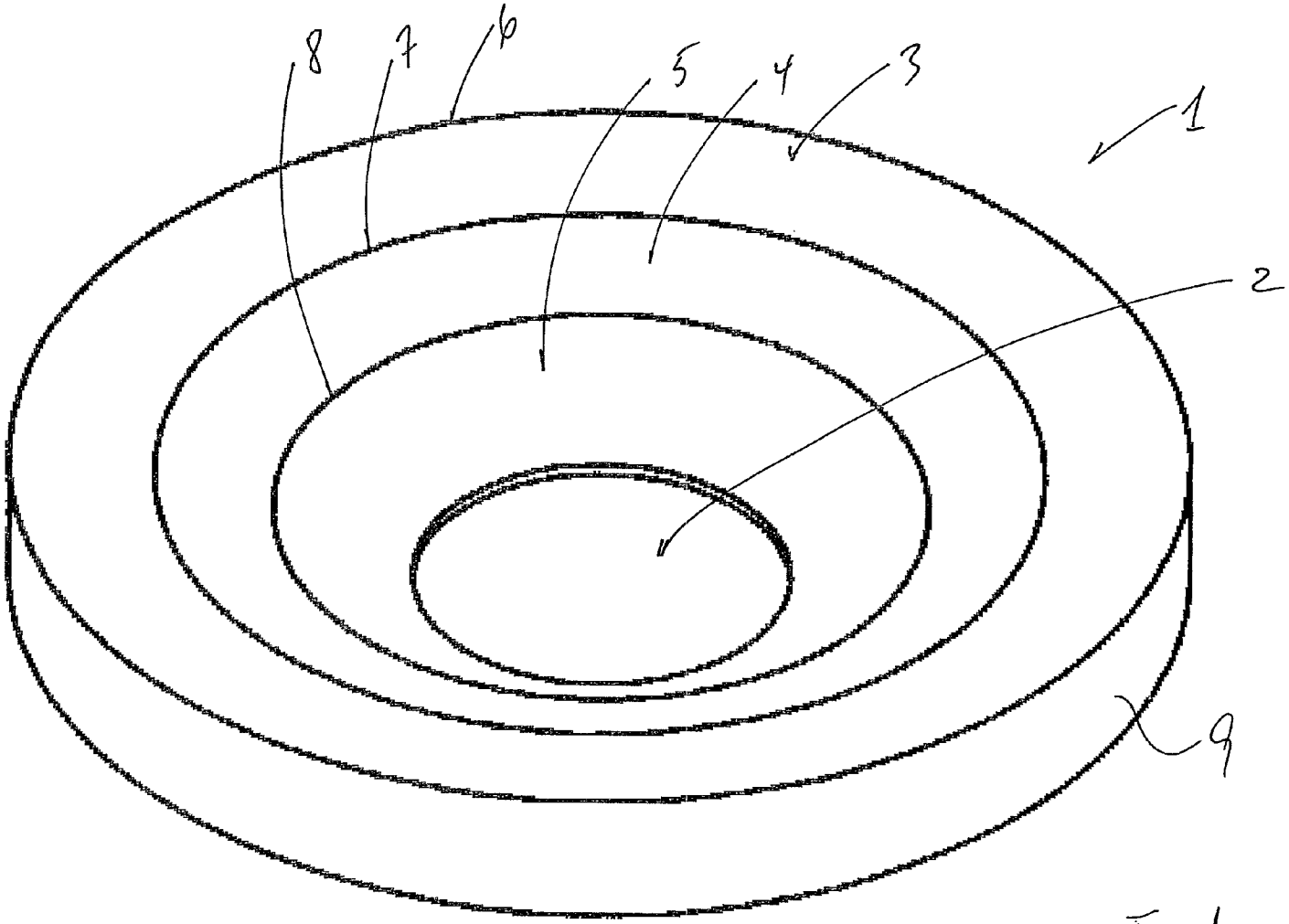

This application claims the benefit of Danish Application No. PA 2005 01276 filed Sep. 13, 2005 and PCT/DK2006/000500 filed Sep. 11, 2006, which are hereby incorporated by reference in their entirety.

SCOPE OF THE INVENTION

The present invention relates to a waveguide unit for use with a transducer unit in particular for use in combination as a horn.

BACKGROUND OF THE INVENTION

In a loudspeaker unit, the sound will usually be divided into two or more frequency bands, a lower and an upper frequency band. The lower band may be the so-called lower frequency range which may for example be from approximately 20 to 2 kHz, and a high frequency band which may for example be from 2 kHz to 20 kHz. In order to relay the sound in the lower frequency band, a transducer unit having a large membrane diameter such as for example a cone membrane is used. In the higher frequency band, a small diameter transducer unit is used, often a so-called dome membrane type transducer.

A particular problem by relaying sound and splitting it up in two or more characteristic frequency bands is the reproduction of the sound where the frequency bands are split,—i.e. in the example mentioned above around 2 kHz. Obviously, where the frequency band has been split into more than two distinct frequency bands, the problem is pre-sent with each split.

The split is usually done in order to reproduce the sound as true to the original sound as possible. The lower frequencies require a relatively large membrane in order to reproduce the sound which is as true to the original as possible. High frequency reproduction requires a relatively small membrane in order to reproduce the sound as truthfully as possible. Therefore, there is a conflict between reproducing lower frequencies and higher frequencies which in the art has been solved by providing transducer units having membranes of different sizes in order to accommodate and provide the sound as close to the original sound as possible. In the frequency area where the split is made, a compromise is reached for example by delimiting at 2 kHz, so that the lower frequencies closer to 2 kHz frequency will have a certain distortion as well as for the higher frequency band, the lower frequencies around the 2 kHz frequency will also have a distortion.

Another factor which also makes it desirable to split up the sound in order to receive a truthful sound reproduction, is the fact that the low frequency unit has a relatively narrow divergence in the midrange frequencies (short wave length in relation to the diameter of the membrane of the transducer unit) whereas the high frequency unit traditionally has a large divergence in the midrange area, and a narrowed divergence in the high frequency area. All in all, these factors lead to a very uneven frequency response characteristic of the sound. The present invention is especially concerned with providing a frequency response characteristic for the high frequency dome transducer which is superior to anything previously suggested in the art.

OBJECT OF THE INVENTION

The present invention addresses this by providing a waveguide unit, for use with a transducer unit, and in particular a transducer of the dome type, where the waveguide unit has a shape in a plane view substantially corresponding to the shape of the transducer unit in a plane view so that the waveguide may be arranged around the outside periphery of the transducer unit, where the waveguide unit has a front side on which front side means are provided for reflecting the sound waves from the transducer, and a substantially flat backside, and where substantially centrally in the unit an aperture is provided which aperture is suitable for accommodating a transducer unit, and the side of said aperture connects the front and back sides of the waveguide unit, where said waveguide comprises one or more diffraction edges arranged equidistant with the shape of the unit on said front side of the unit, and where adjacent on both sides of said one or more diffraction edges, substantially flat inclined surfaces are provided.

BRIEF DESCRIPTION OF THE INVENTION

The improved sound reproduction is due to the fact that the diffraction edges will deflect the sound so that the on-axis sound pressure will have a maximum dampening without dampening the off-axis level. This is due to the fact that, at an imaginary point, P, directly in front of the transducer, the distance between the dome of the transducer unit and P will be the distance C. The distance from the dome to the diffraction edge may be set to be A, and the distance from the diffraction edge to the point P may be set to be B. When the difference A+B is equal to a 180° phase displacement, the on-axis sound level will have a maximum dampening whereas the off-axis level will be unimpeded. The central frequency $F_c$ is equal to the speed of sound divided by ((a+b)−c) whereby it is possible to accurately design the distance from the dome to the diffraction edge very accurately. The reason why the off-axis sound level/pressure is not affected or only affected very minimally is the fact that the sound radiation from the nearest diffraction edges has almost no phase delay compared to the direct sound.

In a further advantageous embodiment of the invention, three diffraction edges are provided, where the radius from the centre of the unit to the first edge is between 30 mm and 40 mm, and where the radius from the centre of the unit to the second edge is between 40 mm and 55 mm, and where the radius from the centre of the unit to the third edge is between 55 mm and 75 mm, and where a circular aperture is provided centrally in the unit which aperture has a diameter between 15 mm and 75 mm. The relative distance between the dome and the diffraction edges provides for the geometric relationship which makes it possible to fulfil the requirements as stated in the equation above. Also with respect to the size of the transducer units used in the high frequency bands, these geometric dimensions for the waveguide unit provide an improved sound distribution in that a substantially linear effect characteristic of a high frequency dome transducer is provided.

In a further advantageous embodiment the unit in a plane view, i.e. as seen from above when the unit is placed on a flat surface, has a substantially circular shape, where said one or more diffraction edges are arranged concentrically with the circular shape of the unit on said front side of the unit, and where adjacent on both sides of said one or more diffraction edges, substantially flat conical surfaces are provided.

As most transducer units used for sound reproduction are circular, this is the most common application example. Furthermore, as opposed to other shapes of transducer units to which the present application is applicable, the circular shape avoids having sharp corners (seen in the plane view). In corner regions special and often detrimental wave reflection patterns may occur, which requires special attention, first of all to the design of the transducer unit, but also to the design of the waveguide, in order to achieve the advantages of the present invention.

Throughout the application the invention will be explained with reference to a substantially circular-shaped transducer, but the waveguide principles may be applied to any shape of transducer unit, such as for example oval, square, rectangular, square or rectangular with rounded corners etc. The examples mentioned shall not be taken as limiting the application of the present invention.

In a further advantageous embodiment, the unit comprises three adjoined flat surfaces, an inner surface, a middle surface and an outer surface, which surfaces are separated by diffraction edges, where the angle between the side of the aperture and the inner surface is between 210° and 275°, and the angle between the inner surface and the middle surface is between 180° and 210°, and where the angle between the middle surface and the outer surface is between 180° and 210°.

The relative angles between the different flat surfaces and thereby the position of the diffraction edges in relation to the dome are important in that the greater the opening angle on the waveguide unit the larger the dispersion in the lower frequency area, but due to the relative dispersion from the dome transducer unit, the diffraction edges will have less effect which will provide for less dispersion at higher frequencies. It is therefore important to be able to design the relative angles between the surfaces separated by the diffraction edges so that an optimum dispersion of sound depending on the chosen frequency bandwidth as discussed above may be optimised.

The further embodiments described in the dependent claims 5 and 6 are all preferred embodiments of the invention which further provide advantages as to the effectiveness and the usefulness as well as the design of the unit per se.

In a further advantageous particular embodiment the waveguide unit as described above is mounted in front of a direct radiation transducer, where said unit has two diffraction edges, which are arranged on the unit according to the calculation: $F_c$=speed of sound/((A+B)−C)$^2$) where $F_c$ is selected within the range 1 kHz to 40 kHz, more preferred 3 kHz to 30 kHz, and most preferred 5 kHz to 20 kHz.

In this configuration a very good compromise between number of diffraction edges and harmonisation of the emitted sound in the specified range is obtained.

The two diffraction edges may be arranged in two distinct embodiments. In a first embodiment, there are only two surfaces on the front face of the waveguide. The first diffraction edge separates the two surfaces. The second diffraction edge is in fact the very outer edge of the waveguide. This is possible where the outer surface (furthest away from the central aperture provided for the transducer) is not parallel with the surface on which the waveguide is mounted or integrated into.

The second embodiment is the case where the outer surface is parallel to the mounting surface. In this embodiment, it is necessary to have three surfaces separated by the two diffraction edges.

Although the waveguide has been presented as a separate member/unit, it is contemplated that the diffraction edges and surfaces may be integrated in the housing in which the transducer unit(s) are arranged so that the housing and the waveguide may be one single unit.

SHORT DESCRIPTION OF THE DRAWING

Figure 2:
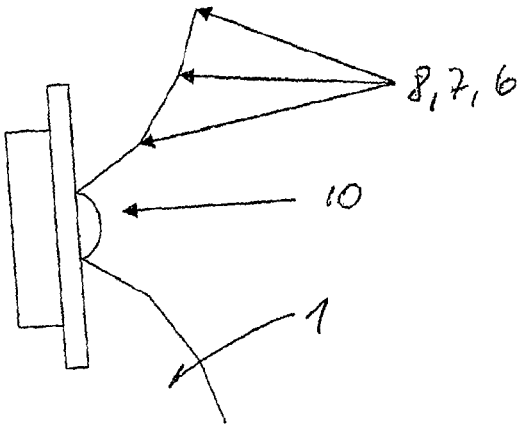
Figure 3:
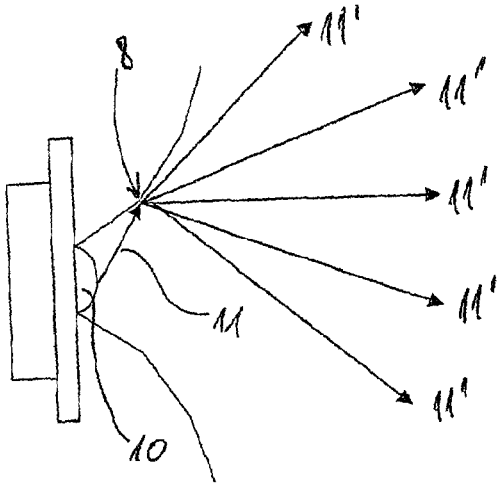
Figure 4:
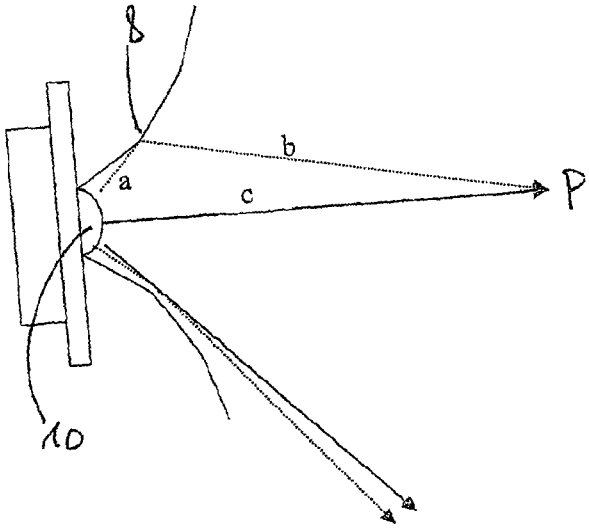

The invention will now be described with reference to the accompanying drawing, wherein FIG. 1 illustrates an isometric view of a waveguide unit according to the invention, FIG. 2 illustrates a cross-section through a waveguide unit in combination with a dome transducer, FIG. 3 illustrates the dispersion of sound on a diffraction edge, and FIG. 4 illustrates the theory behind the design of the waveguide unit according to the invention.

DETAILED DESCRIPTION OF THE INVENTION

Turning to FIG. 1, a waveguide unit 1 is illustrated. The waveguide in this example comprises an aperture 2. The aperture has a size which may accommodate a transducer unit, preferably of the dome type such that the inventive characteristics of the inventive waveguide unit may be utilised.

Three conical surfaces 3,4,5 are surrounding the aperture 2. The conical surfaces 3,4,5 are separated by diffraction edges 6,7,8 where the diffraction edge 6 in this example also connects with the side 9 of the waveguide unit. The surfaces are substantially flat in the radial direction.

The waveguide unit is furthermore provided with a substantially flat backside which is not visible in this view.

Turning to FIG. 2, a cross-section through a waveguide unit in combination with a transducer unit is illustrated. The details of the transducer unit are not explicit as only the dome 10 is important with relation to the waveguide unit 1. As may be deducted from FIG. 2, the diffraction edges 6,7,8 as well as further illustrated in FIG. 3 diffract the sound as a sound wave, illustrated by the arrow 11 emitted from the dome 10, will hit the first diffraction edge 8 whereby the sound wave 11 will be diffracted into a wider sound wave spectrum illustrated by the arrows 11'.

The theory behind the design and development of the waveguide unit according to the present invention is illustrated with reference to FIG. 4.

The dome unit 10 will emit sound waves in all directions substantially perpendicular to the surface of the dome. The sound will be emitted by the speed of sound so that it will take the sound wave C a certain amount of time to travel the distance from the surface of the dome 10 to the imaginary point P. A sound wave A also being emitted from the dome 10 will be diffracted by the diffraction edge 8 and thereby reach the point P by means of the travelling distance indicated by B. By placing the diffraction edge at an appropriate place, it is possible to design the waveguide unit so that the distance A+B in relation to the distance C will be equal to an approximately 180° phase displacement so that the off-axis level of the sound pressure will be unaffected whereas the on-axis level will be dampened. The equation for designing the waveguide in accordance with a given frequency will be the following:

$$Fc=\text{speed of sound}/((A+B)-C)$$

The number of diffraction edges may be chosen to be any appropriate number, but tests have indicated that between 2 and 7 diffraction edges provide an improved sound pressure in that the linearization between the different frequencies being emitted by the high frequency transducer unit for example in the frequency band of 2 kHz to 20 kHz using a small diameter dome membrane is improved in relation to traditional waveguides.

Depending on the expected performance of the transducer unit, the waveguide unit may be manufactured from any suitable material—the higher the load the more stiff and non-resilient the material. For these uses, different aluminium alloys are preferred. Other materials such as ceramics, and for lower performance transducer units, other materials such as plastics or other reinforced polymers may be utilised.

Other variations and improvements of the invention may be contemplated within the scope of the appended claims.

The invention claimed is:

1. Waveguide unit, for use with a transducer unit, and in particular a transducer of the dome type, where the waveguide unit has a shape in a plane view substantially corresponding to the shape of the transducer unit in a plane view so that the waveguide may be arranged around the outside periphery of the transducer unit, where the waveguide unit has a front side on which a front side is provided for reflecting the sound waves from the transducer, and a substantially flat backside, and where substantially, centrally in the waveguide unit an aperture is provided which aperture is suitable for accommodating a transducer unit, and the side of said aperture connects the front and back sides of the waveguide unit, where said waveguide comprises one or more diffraction edges arranged equidistant with the shape of the waveguide unit on said front side of the waveguide unit, and where adjacent on both sides of said one or more diffraction edges, substantially flat inclined surfaces are provided.

2. Waveguide unit according to claim 1, wherein the waveguide unit in a plane view has a substantially circular shape, and that said one or more diffraction edges are arranged concentric with the circular shape of the unit on said front side of the waveguide unit, and that adjacent on both sides of said one or more diffraction edges, substantially flat conical surfaces are provided.

3. Waveguide unit according to claim 1, wherein three diffraction edges are provided, and that the distance or radius from the centre of the waveguide unit to the first edge is between 30 mm and 40 mm, and that the distance or radius from the centre of the waveguide unit to the second edge is between 40 mm and 55 mm, and that the distance or radius from the centre of the waveguide unit to the third edge is between 55 mm and 75 mm, and that an aperture is provided centrally in the waveguide unit which aperture has a width between 15 mm and 100 mm and a height perpendicular to but in the same plane as the width of between 50 mm and 100 mm, or where the aperture is circular said aperture has a diameter between 15 mm and 75 mm.

4. Waveguide unit according to claim 1, wherein the waveguide unit comprises three adjoined flat surfaces, an inner surface, a middle surface and an outer surface, which surfaces are separated by diffraction edges, and that the angle between the side of the aperture and the inner surface is between 210° and 275°, and the angle between the inner surface and the middle surface is between 180° and 210°, and that the angle between the middle surface and the outer surface is between 180° and 210°.

5. Waveguide unit according to claim 4, wherein the angle between the side of the aperture and the inner surface is 240°+/−2°, and the angle between the inner surface and the middle surface is 190°+/−2°, and that the angle between the middle surface and the outer surface is between 191°+/−2°.

6. Waveguide unit according to claim 1, wherein the distance from the centre of the waveguide unit to the first edge is 35 mm+/−4 mm and that the distance from the centre of the waveguide unit to the second edge is 47 mm+/−4 mm and that the radius of the central aperture is 40 mm+/−10 mm.

7. Waveguide unit according to claim 1, wherein the waveguide unit is made from a single piece, where the material is chosen from aluminium and/or different alloys, stainless steel, steel, plastics or modified plastics, ceramics, ceramics comprising fibres or similar materials.

8. Waveguide unit according to claim 1, wherein the unit is mounted in front of a direct radiation transducer, where said waveguide unit has minimum two diffraction edges, which are arranged on the waveguide unit according to the equation: $F_c$=speed of sound/((A+B)−C) where $F_c$ is selected within the range 1 kHz to 40 kHz, more preferred 3 kHz to 30 kHz, and most preferred 5 kHz to 20 kHz.

9. Wave guide unit, for use with a transducer unit, and in particular a transducer of the dome type, where the waveguide unit has a shape in a plane view substantially corresponding to the shape of the transducer unit in a plane view so that the waveguide unit may be arranged around the outside periphery of the transducer unit, where the waveguide unit has a front side and a substantially flat backside; and the waveguide unit is substantially, centrally provided with an aperture suitable for accommodating the transducer unit, the side of said aperture connecting the front and back sides of the waveguide unit; wherein diffraction means are provided on said front side for reflecting the sound waves from the transducer unit, said diffraction means comprising one or more diffraction edges arranged equidistant with the shape of the waveguide unit on said front side, and wherein adjacent on both sides of said one or more diffraction edges, substantially flat inclined surfaces are provided.

* * * * *